US005636757A

United States Patent [19]

Porvaznik

[11] Patent Number: 5,636,757

[45] Date of Patent: Jun. 10, 1997

[54] BOTTLE STOPPER WITH INTEGRAL REMOVER

[76] Inventor: Tom Porvaznik, 50 Gould St., Clifton, N.J. 07013

[21] Appl. No.: 604,771

[22] Filed: Feb. 22, 1996

[51] Int. Cl.[6] ..... B65D 39/00

[52] U.S. Cl. ..... 215/364; 215/296; 215/355; 220/254; 220/789; 220/793; 220/805; 220/DIG. 19

[58] Field of Search ..... 215/364, 355, 215/296, 297, 299, 300; 220/254, DIG. 19, 787, 789, 793, 309.2, 797, 800, 801, 805; 217/98, 103, 108, 110, 113, 114

[56] References Cited

U.S. PATENT DOCUMENTS

| | | | |
|---|---|---|---|
| 766,206 | 8/1904 | Westling | 217/110 |
| 1,571,023 | 1/1926 | Pekora | 217/110 |
| 2,046,224 | 6/1936 | Vanderhoof | 215/296 |
| 4,574,662 | 3/1986 | Jones | 81/3.45 |
| 4,798,106 | 1/1989 | Foster | 81/3.29 |
| 5,086,675 | 2/1992 | Leung et al. | 81/3.29 |
| 5,134,906 | 8/1992 | Sit | 81/3.09 |
| 5,257,565 | 11/1993 | Hung | 81/3.29 |

FOREIGN PATENT DOCUMENTS

| | | | |
|---|---|---|---|
| 533492 | 11/1956 | Canada | 220/237 |
| 2622871 | 5/1989 | France | 220/234 |

*Primary Examiner*—Allan N. Shoap
*Assistant Examiner*—Robin A. Hylton

[57] ABSTRACT

A device for removing a cork from a bottle opening. This is achieved by a cork retriever. The cork retriever has two components, a sleeve and a plunger. The sleeve is adapted to be driven through the cork member while the plunger is adapted to be driven into the sleeve to thereby lock the sleeve in the cork. The cork can then be removed by way of a pull ring which is positioned at the upper end of the sleeve.

3 Claims, 3 Drawing Sheets

BOTTLE STOPPER WITH INTEGRAL REMOVER

BACKGROUND OF THE INVENTION

1. Field of the Invention

The present invention relates to a new and improved stopper for use in conjunction with a bottle opening and, more particularly, pertains to a system for removing a cork from a bottle opening.

2. Description of the Prior Art

The use of bottle caps is known in the prior art. More specifically, bottle caps heretofore devised and utilized for the purpose of providing devices for releasably closing a bottle opening are known to consist basically of familiar, expected, and obvious structural configurations, notwithstanding the myriad of designs encompassed by the crowded prior art which has been developed for the fulfillment of countless objectives and requirements.

The prior art discloses a large number of devices for releasably closing a bottle opening. By way of example, U.S. Pat. Nos. 4,574,662; 4,798,106; 5,086,675; 5,134,906; and 5,257,565 each disclose bottle closure members.

In this respect, the stopper for use in conjunction with a bottle opening according to the present invention substantially departs from the conventional concepts and designs of the prior art, and in doing so provides an apparatus primarily developed for the purpose of providing a system for removing a cork from a bottle opening.

Therefore, it can be appreciated that there exists a continuing need for a new and improved stopper for use in conjunction with a bottle opening which can be used as a system for removing a cork from a bottle opening. In this regard, the present invention substantially fulfills this need.

SUMMARY OF THE INVENTION

In view of the foregoing disadvantages inherent in the known types of bottle caps now present in the prior art, the present invention provides an improved stopper for use in conjunction with a bottle opening. As such, the general purpose of the present invention, which will be described subsequently in greater detail, is to provide a new and improved stopper for use in conjunction with a bottle opening and methods which have all the advantages of the prior art and none of the disadvantages.

To attain this, the present invention essentially comprises a new and improved stopper for use in conjunction with a bottle opening, the stopper comprising, in combination, a major cylindrical cork member having an upper surface and a lower surface, a side wall tapering inwardly from the upper to the lower surface, the cork adapted to be positioned within a bottle opening; a cork retriever comprising a sleeve having an upper end and a lower end and a hollow cylindrical interior, a side wall tapering inwardly from the upper toward the lower end, an enlarged end portion integrally formed at the lower end of the sleeve, three equally spaced slots formed through the side wall and the end portion dividing the side wall and end portion into a first, second and third component, a pull ring attached to the upper end of the sleeve; a cylindrical plunger having an enlarged upper portion and a side wall of a uniform cross-section; and the sleeve adapted to be driven through the cork member such that the lower end of the sleeve protrudes from the lower surface of the cork member, the plunger adapted to be driven into the hollow cylindrical interior of the sleeve while it is positioned within the cork member, the plunger functioning to expand the three components of the sleeve away from one another to lock the sleeve within the cork such that the cork can be removed from the bottle opening by way of the pull ring.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved stopper for use in conjunction with a bottle opening which has all the advantages of the prior art bottle caps and none of the disadvantages.

It is another object of the present invention to provide a new and improved stopper for use in conjunction with a bottle opening which may be easily and efficiently manufactured and marketed.

It is a further object of the present invention to provide a new and improved stopper for use in conjunction with a bottle opening which is of a durable and reliable construction.

An even further object of the present invention is to provide a new and improved stopper for use in conjunction with a bottle opening which is susceptible of a low cost of manufacture with regard to both materials and labor, and which accordingly is then susceptible of low prices of sale to the consuming public, thereby making such bottle caps economically available to the buying public.

Still yet another object of the present invention is to provide a new and improved stopper for use in conjunction with a bottle opening which provides in the apparatuses and methods of the prior art some of the advantages thereof, while simultaneously overcoming some of the disadvantages normally associated therewith.

Even still another object of the present invention is to provide a system for removing a cork from a bottle opening.

Lastly, it is an object of the present invention to provide a device for removing a cork from a bottle opening. This is achieved by a cork retriever. The cork retriever has two components, a sleeve and a plunger. The sleeve is adapted to be driven through the cork member while the plunger is adapted to be driven into the sleeve to thereby lock the sleeve in the cork. The cork can then be removed by way of a pull ring which is positioned at the upper end of the sleeve.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
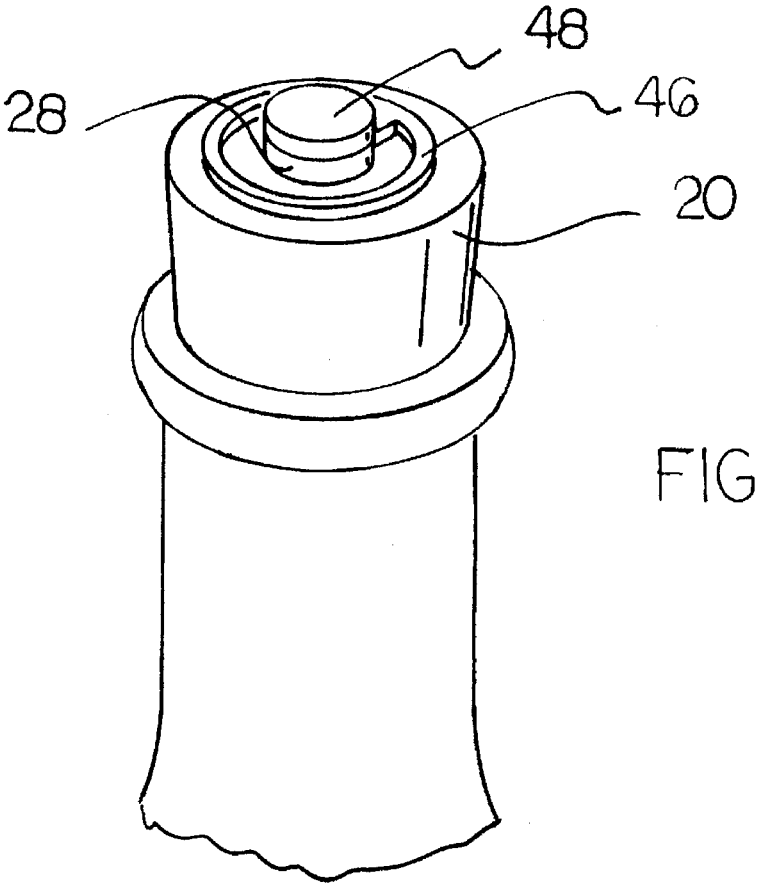
FIG. 1 is a perspective illustration of the stopper for use in conjunction with a bottle opening.
Figure 2:
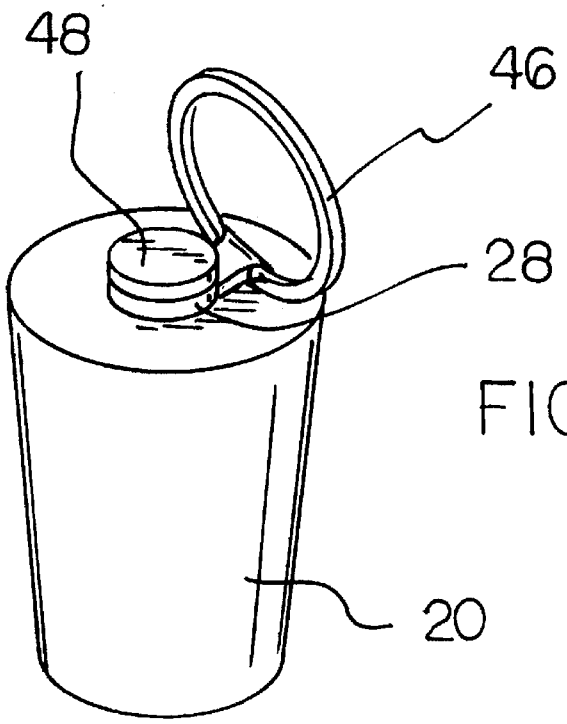
FIG. 2 is a perspective illustration of the stopper with the pull ring in an upright orientation.
Figure 3:
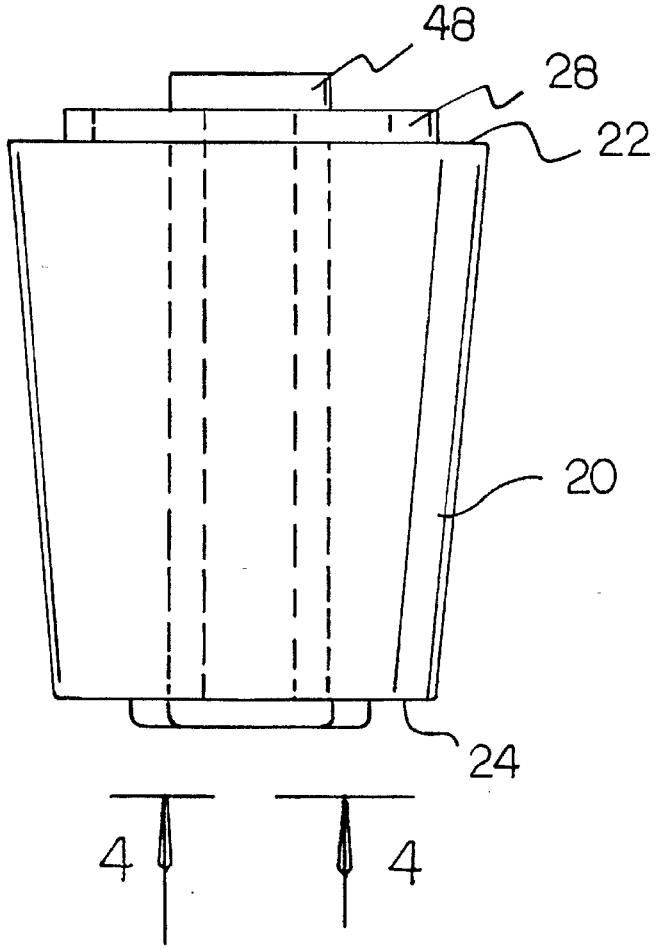
FIG. 3 is a side view of the stopper in accordance with the present invention.
Figure 4:
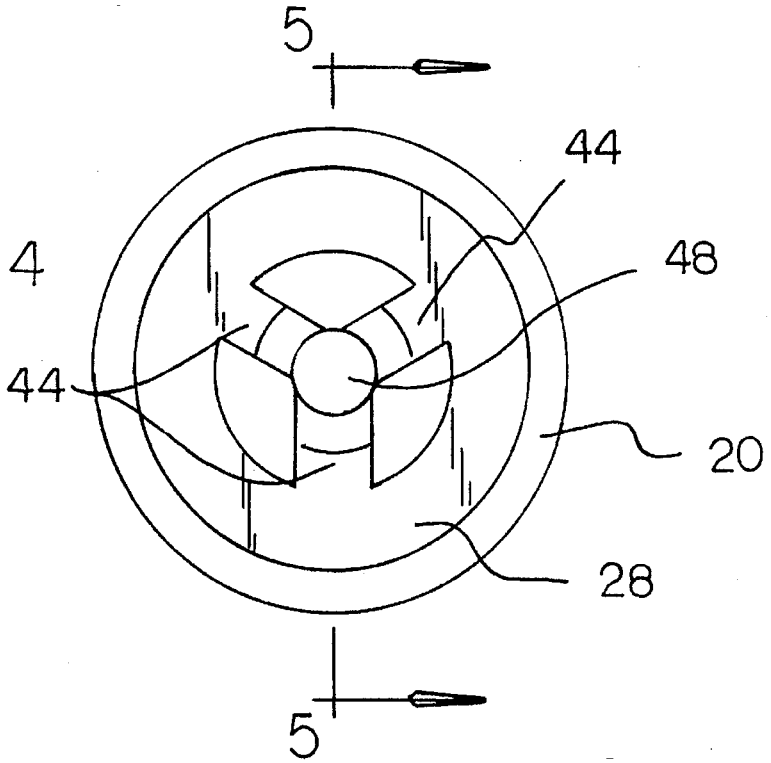
FIG. 4 is a view taken along line 4—4 of FIG. 3.
Figure 5:
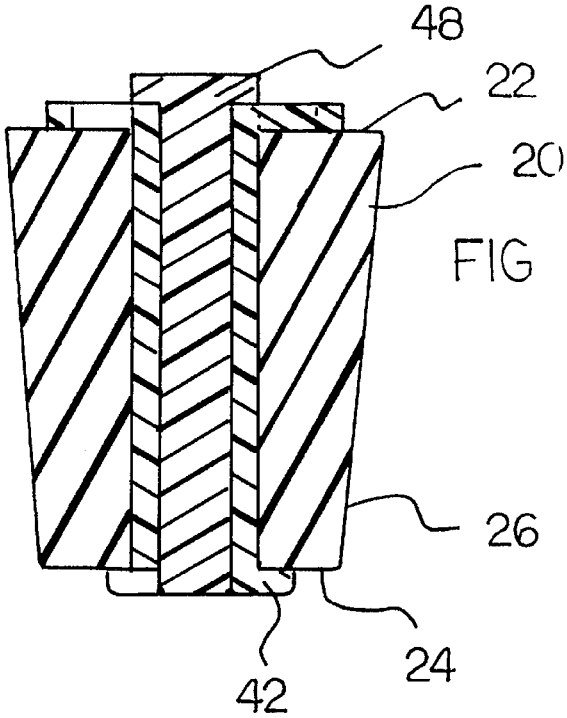
FIG. 5 is a view taken along line 5—5 of FIG. 4.
Figure 6:
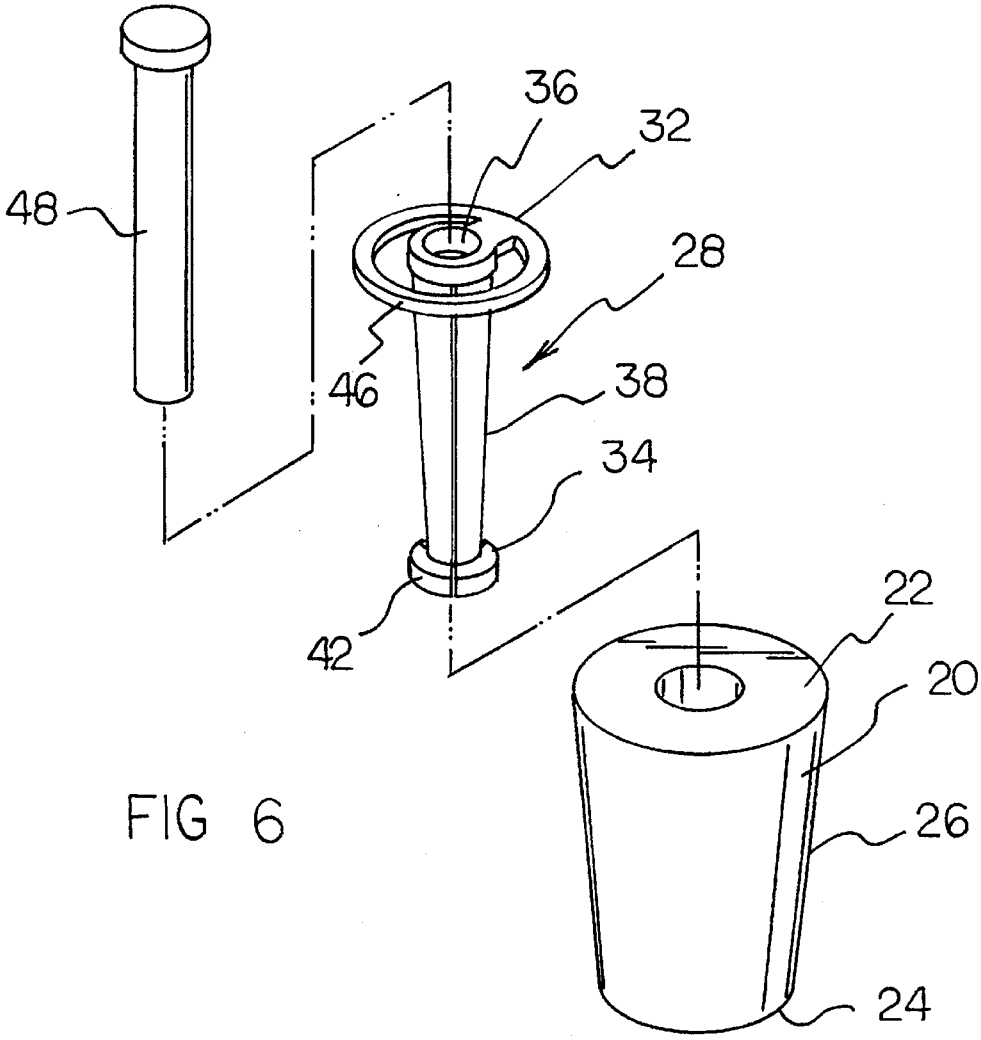
FIG. 6 is an exploded view of the stopper arrangement in accordance with the present invention.

With reference now to the drawings, and in particular to FIG. 1 thereof, the preferred embodiment of the new and improved stopper for use in conjunction with a bottle opening embodying the principles and concepts of the present invention and generally designated by the reference numeral 10 will be described.

The present invention relates to a stopper for use in conjunction with a bottle opening. Specifically, the stopper is adapted for cooperation with a wine bottle opening or an opening usually closed by way of a cork. In its broadest context, the invention includes a cylindrical cork member which is adapted to close the bottle opening. Furthermore, a cork retriever is included for use in retrieving the cork from the bottle opening. This cork retriever includes a sleeve member and a plunger member. The details as to the various components of the present invention, and the manner in which they interrelate, will be described in greater detail hereinafter.

The major cylindrical cork member 20 is defined by an upper surface 22 and a lower surface 24 with a side wall 26 which tapers from the upper surface 22 to the lower surface 24. The cork is adapted to be positioned within a bottle opening in a conventional manner. Although a cork material is preferred, other materials can be employed for this member. Namely, a plastic cylindrical member can also be utilized.

The present invention generally relates to a means for retrieving the cork member from the bottle opening. Specifically, a cork retriever is employed in retrieving the cork from the bottle opening. This cork retriever comprises a sleeve 28 having an upper end 32 and a lower end 34 and a hollow cylindrical interior 36. Furthermore, a side wall 38 tapers from the upper end 32 towards the lower end 34. Furthermore, an enlarged end portion 42 is integrally formed at the lower end 34 of the sleeve 28. Three equally spaced slots 44 are formed through the side wall 38 and the end portion 42. These three equally spaced slots divide the side wall 38 and the end portion 42 into a first, second and third component. More specifically, each of the slots is separated from one another by an angle of 120 degrees. A pull ring 46 is attached to the upper end of the sleeve 28. In a preferred embodiment, this pull ring 46 takes the form of a string which is attached to the upper end of the sleeve 28. The function of the pull ring 46 will be discussed in greater detail hereinafter.

A second component of the cork retriever is a cylindrical plunger 48. This cylindrical plunger is defined by an enlarged upper portion and a side wall. In the preferred embodiment, the side wall is of a uniform cross-section. This cylindrical plunger 48 is adapted to be positioned within the hollow cylindrical interior 36 of the sleeve 28.

Thus, the sleeve 28 is adapted to be driven through the cork member 26 while the cork member is positioned within a bottle opening. The sleeve 28 is driven through the cork member 26 such that the lower end 34 of the sleeve 28 protrudes from the lower surface 24 of the cork member 26. Next, the plunger 48 is driven into the hollow interior 36 of the sleeve 28 while it is positioned within the cork member 20. The plunger 48 functions to expand the three components of the sleeve 28 away from one another. This then functions to lock the sleeve 28 within the cork 20. Now, the pull ring 46 can be employed to remove the cork from the bottle opening.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stopper for use in conjunction with a bottle opening, the stopper comprising:

a cylindrical cork member having an upper surface and a lower surface, a side wall tapering inwardly from the upper to the lower surface, the cork positionable within a bottle opening;

a cork retriever comprising a sleeve having an upper end and a lower end and a hollow cylindrical interior, a side wall tapering inwardly from the upper toward the lower end, an enlarged end portion integrally formed at the lower end of the sleeve, three equally spaced slots formed through the side wall and the enlarged end portion dividing the side wall and enlarged end portion into a first, second and third component, a pull ring attached to the upper end of the sleeve;

a cylindrical plunger having an enlarged upper portion and a side wall; and the sleeve driven through the cork member such that the lower end of the sleeve protrudes from the lower surface of the cork member, the plunger driven into the hollow cylindrical interior of the sleeve while it is positioned within the cork member, the plunger functioning to expand the three components of the sleeve away from one another to lock the sleeve within the cork such that the cork can be removed from the bottle opening by way of the pull ring.

2. The device as described in claim 1 wherein:

the plunger is of a uniform cross-section.

3. A stopper for use in conjunction with a bottle opening, the stopper comprising, in combination:

a cylindrical cork member having an upper surface and a lower surface, a side wall tapering inwardly from the upper to the lower surface, the cork positionable within a bottle opening;

a cork retriever comprising a sleeve having an upper end and a lower end and a hollow cylindrical interior, a side wall tapering inwardly from the upper toward the lower end, an enlarged end portion integrally formed at the lower end of the sleeve, three equally spaced slots formed through the side wall and the enlarged end portion dividing the side wall and enlarged end portion into a first, second and third component, a pull ring attached to the upper end of the sleeve;

a cylindrical plunger having an enlarged upper portion and a side wall of a uniform cross-section; and the sleeve driven through the cork member such that the lower end of the sleeve protrudes from the lower surface of the cork member, the plunger driven into the hollow cylindrical interior of the sleeve while it is positioned within the cork member, the plunger functioning to expand the three components of the sleeve away from one another to lock the sleeve within the cork such that the cork can be removed from the bottle opening by way of the pull ring.

* * * * *